US005451118A

United States Patent [19]

Wilkins et al.

[11] Patent Number: 5,451,118

[45] Date of Patent: Sep. 19, 1995

[54] HIGH-DENSITY, LOW PROFILE TRAFFIC CHANNELIZER BASE

[75] Inventors: David M. Wilkins, Port Stanley, Canada; George K. Huntington, Little Rock, Ark.

[73] Assignee: Flex-O-Lite, Inc., St. Louis, Mo.

[21] Appl. No.: 344,355

[22] Filed: Nov. 23, 1994

Related U.S. Application Data

[63] Continuation of Ser. No. 102,571, Aug. 5, 1993, abandoned.

[51] Int. Cl.[6] ..... E01F 13/02

[52] U.S. Cl. ..... 404/6; 404/10

[58] Field of Search ..... 404/6, 9, 10, 12, 13; 256/13.1; D10/109; 40/612; 116/63 P, 63 C; 220/603; 248/910

[56] References Cited

U.S. PATENT DOCUMENTS

| | | | |
|---|---|---|---|
| 2,448,413 | 8/1948 | Borghesi | 248/194 |
| 2,762,327 | 9/1956 | Weig | 116/63 |
| 2,843,347 | 7/1958 | King | 248/44 |
| 2,977,864 | 4/1961 | Puller | 94/22 |
| 3,119,588 | 1/1964 | Keats | 248/158 |
| 3,471,114 | 10/1969 | Ball | 248/346 |
| 3,618,556 | 11/1971 | Dittrich | 116/63 P |
| 3,738,309 | 6/1973 | Nicholl | 116/63 |
| 4,083,033 | 4/1978 | Kulp et al. | 340/114 |
| 4,145,044 | 3/1979 | Wilson et al. | 273/1.5 |
| 4,303,349 | 12/1981 | Upton | 404/6 |
| 4,312,600 | 1/1982 | Schaaf et al. | 404/6 |
| 4,475,101 | 10/1984 | Kulp et al. | 340/114 |
| 4,596,489 | 6/1986 | Mariol et al. | 404/9 X |
| 4,611,949 | 9/1986 | Schmanski | 404/9 |
| 4,674,431 | 6/1987 | Cory | 116/63 |
| 4,688,766 | 8/1987 | Zucker | 256/131 |
| 4,710,053 | 12/1987 | Kulp et al. | 404/9 |
| 4,973,190 | 11/1990 | Erwin et al. | 404/9 X |
| 5,026,204 | 6/1991 | Kulp et al. | 404/10 |
| 5,036,791 | 8/1991 | Thurston | 116/63 C |
| 5,103,616 | 4/1992 | Nordberg | 52/585 |
| 5,165,818 | 11/1992 | Newhart | 404/10 |
| 5,199,814 | 4/1993 | Clark et al. | 404/10 |
| 5,201,599 | 4/1993 | Kulp et al. | 404/6 |
| 5,234,280 | 8/1993 | Cowan | 404/6 |

FOREIGN PATENT DOCUMENTS

| | | | |
|---|---|---|---|
| 2101180 | 1/1983 | United Kingdom | 404/6 |

*Primary Examiner*—Michael Powell Buiz
*Assistant Examiner*—James A. Lisehora
*Attorney, Agent, or Firm*—Edward H. Renner

[57] ABSTRACT

An improved two-piece, detachable traffic device features a high-density, low-profile solid base. The base is, preferably, made of a molded unitary composition made of recycled rubber products, such as, spent motor vehicle tires. Further, it is molded such that it can be stacked for ease of storage with similar bases. The combined high-density and low profile aspects of the base cooperate to ensure both that the base remains stationary during use and can easily be traveled over by a vehicle without damage resulting to the base or the vehicle.

6 Claims, 1 Drawing Sheet

HIGH-DENSITY, LOW PROFILE TRAFFIC CHANNELIZER BASE

This is a continuation of application Ser. No. 08/102571 filed on Aug. 5, 1993, now abandoned. This application is a continuation of application Ser. No. 08/102,571, filed Aug. 5, 1993, now abandoned.

FIELD OF THE INVENTION

This invention relates to an improved traffic channeling device and, more particularly, to a two-piece, detachable device consisting of a barrel and a base, the base being of a high-density, unitary construction and specially adapted to remain stationary and free from entanglement with a motor vehicle following impact. We are aware of the following U.S. patents, the disclosures of which are incorporated by reference herein.

U.S. Pat. No. 4,083,033
U.S. Pat. No. 5,026,204
U.S. Pat. No. 5,201,599

BACKGROUND OF THE INVENTION

Two piece traffic channelizing devices are used to warn and alert motorists of hazardous conditions existing on or about roadways as well as to direct or channel them along a designated course which may differ from the ordinary traffic route.

Channelizers exist in a great many configurations and are made from a number of materials. For example, fifty gallon steel drums have found application as channeling devices as have the orange, rubber cones with which most are familiar. Steel drums have largely been supplanted by plastic barrels, which are commonly used in situations where traffic channelization is intended for a sustained period of time or where high visibility is required. These plastic barrels are of a size and appearance suggestive of the steel drums and appear sufficiently formidable to warn motorists of hazards.

In order to impart added stability to plastic barrels, they are often filled with ballast,, typically, sand. In use, and particularly when ballasted, plastic barrels have proven to be effective, stationary devices capable of withstanding movement caused by wind and environmental variables or the irregular turbulence created by large, fast moving motor vehicles.

Despite the inherent stationary advantages, there are disadvantages which derive from the use of ballast, particularly sand, as stabilizing material for traffic channelizers. It has been shown that, when the sand is spilled onto the roadway as the result of impact, it can create a condition which greatly impairs the motorist's ability to maintain control over the vehicle; both braking and steering can be affected.

An example of a ballasted plastic barrel is disclosed in U.S. Pat. No. 4,083,033. Therein, a two-piece plastic drum is disclosed that can be assembled or detached and is characterized by having a plastic upper drum element and a plastic base configured in the nature of an open tray for receipt of a ballast. Because it is inexpensive, readily available and relatively soft, sand is often selected for ballast. The device provides for the placement of loose or bagged sand placed in the open tray of the base thereby imparting stability.

Certain significant problems are inherent to the two-piece device (actually a three-piece device given the requirement of a separate ballast) when in use. Specifically, in ballasting with sand, the sand is most commonly placed in bags or stored in a soft breakable container which will dispense the sand when either run over by a motor vehicle tire or ripped by the vehicle undercarriage. Accordingly, sand is often spread across the roadway when the device is impacted. This is undesirable from a safety perspective in that sand on dry pavement is known to reduce the friction coefficient between pavement and the surface of a tire, thereby increasing braking distances and making steering difficult. From an additional practical standpoint, the displacement of sand out of the ballast tray of the base creates more work and expense in that, prior to subsequent use, the sand ballast must be replaced and the dispersed sand removed from the roadway.

An additional disadvantage relating to the device is that the base is typically made from a flexible, thermoformed plastic. Often several impacts, and particularly when the base is either run over by a vehicle tire or entangled with the vehicle undercarriage, the base is damaged to the point that it can't be reused. Accordingly, the base element fails to provide important safety and durability considerations.

In U.S. Pat. No. 5,026,204 the configuration of the base element is modified to provide for a molded, hollow chamber, which is filled through an opening, and then sealed. The vertical, height of this base is four inches. The base requires the inconvenient step of adding sand to the base—a function which invites human error. Moreover, by its nature, the thermoformed material comprising the base is vulnerable to the extremes and adverse affects of environmental factors, which factors invariably, threaten the structural integrity of the base, leading ultimately, to rupture of the base and dispersal of sand onto the surrounding pavement.

U.S. Pat. No. 5,201,599 also discloses a ballast base. Like U.S. Pat. No. 5,026,204, this disclosure involves a molded, hollow chamber with an opening and a cover for receipt of a ballast and for use in conjunction with a first, barrel-like element. As distinguished from the preceding invention, however, the invention of this patent requires the placement of a solid ballast means within the dome-shaped, molded chamber. The disadvantages associated with this device are similar to those described above with respect to convenience, the possibility that the ballast will not be securely added to the base in order to avoid leakage, and the short life expectancy of the base due to the material of which it is comprised and the stress imposed upon that material by extreme environmental factors as well as that caused by the repeated insertion and removal of ballasting means.

The present invention overcomes the disadvantages described above and introduces the first truly two-piece channelizing device. The base element does not require the addition of a separate ballasting material. Accordingly, the present invention avoids the aforedescribed problems associated with fillable, thermoformed base elements by providing a virtually indestructible, high-density, ultra low-profile and unitarily constructed solid base element made from an inexpensive material, such as recycled rubber.

Disposal of used motor vehicle tires has become a major environmental problem. Landfill approval and environmental standards grow increasingly strict; fewer acceptable means of disposal remain. The present invention, contributes to solution of the tire disposal problem by providing an additional commercial use for recycled tires. The instant invention, presents an environmentally prudent and responsible alternative to the landfilling of used motor vehicle tires.

The properties of rubber include exceptional durability, high density and a natural elastic character. We have used this material to produce a base element which unexpectedly eliminates many of the hereto required labor steps and associated adverse safety implications of post-manufacture ballasting, while providing a device of exceptionally low profile suitable for being repeatedly impacted by motor vehicles without threat to its structural integrity, and thus, its expected useful life. Moreover, the exceptionally low profile mitigates against loss of control of a motor vehicle, as can occur due to tire contact with a thick conventional base and ballast.

SUMMARY OF THE INVENTION

The present invention provides an improved base for a traffic channelizing device which, due to its structural departure from conventional devices, materially improves upon the convenience of using and performance of traffic channelizing elements of the type known in the art. In particular, the improved base element for a two-piece attachable and detachable device eliminates the requirement that the base element be separately ballasted following manufacture and prior to use. Because of its high-density, unitary construction from recycled materials, low profile and specially molded configuration, the base is easily handled, is stackable, and is an economical, convenient, environmentally responsible and practical base for traffic barrels.

The base element is preferably a high-density, solid rubber molded article that does not require the addition of ballast, of any form, following manufacture and prior to use. The base is typically used in conjunction with a hollow element having a barrel-like configuration used for traffic channelization signaling purposes and adapted for attachment with and detachment from the base element. The base has sufficient weight to ballast the combined base and channelizer, i.e., plastic barrel, from displacement for example, from wind gusts. The base typically weighs from about thirty to fifty pounds, preferably about forty pounds.

The base element is also advantageously configured with a low profile, not exceeding three inches when measured at its highest vertical point, that allows a base element that has been separated from the top element of the channelizer to have the desired clearance to fit under a motor vehicle as it passes over the element without engaging the undercarriage of the motor vehicle or any parts that may protrude therefrom. Unlike conventional base elements, the base element of this invention is of a solid construction. Therefore, the base element does not rupture when impacted, as described, thereby leaking ballast and compromising the utility of the device.

Owing both to its high-density and low profile features, the instant base element is designed to remain substantially in place even when impacted by a motor vehicle. On impact, the hollow element of barrel-like configuration, to which the base is attached, typically separates on account of the contact force. This aspect of the invention constitutes an important safety advance over the prior art in that existing sand-ballasted base elements, whether sealed within the base or disposed atop a base element (loose or bagged), present an obstacle to the motor vehicle once it has impacted the channelizer, sometimes resulting in loss of control of the vehicle due to engagement of the vehicle tires or underside with a sand-ballasted base unit. Moreover, and as described more fully above, the spreading of sand upon the roadway following impact and rupture may create a wholly separate and added safety hazard.

The solid, unitary base of the present invention is also novel in the art because, unlike conventional sand-ballasted elements that are either dome-shaped or tray-configured and made of thermoformed plastic, the solid low profile and high-density rubber base provided hereby is designed to remain substantially in place while, simultaneously, fully withstanding being repeatedly driven over by all forms of motor vehicles without sacrifice of structural integrity and without becoming entangled with vehicle underbodies. In addition, a problem common to sand-ballasted base elements and relating to the detachment of the base from the barrel element upon impact, due to the effect of dispersed and, is also overcome. A yet further advantage of the base element provided hereby resides in its ability to adapt for use with conventional commercially available top channelizer elements—obviating the need to purchase completely new top elements.

The present invention broadly embraces both a base element and a combined hollow, barrel-like top element. The top element may be of conventional design attachable to the base by a snap fit engagement. The base is generally planar. The top surface of the base is formed to define a generally flat upper region. The bottom surface of the base contacts the ground when the base is normally positioned. The bottom surface may be relieved to reduce the weight of the base and to increase the local contact force. The relieved areas may be bound by webs for strengthening the base. There may also be additional features, such as an aperture to receive an elongate, reflectorized delineator post or a sign stand.

These and other features will be apparent from the Drawings and from the following Brief Description of the Drawings and Description of the Preferred Embodiments.

DESCRIPTION OF THE PREFERRED EMBODIMENTS

Figure 1:
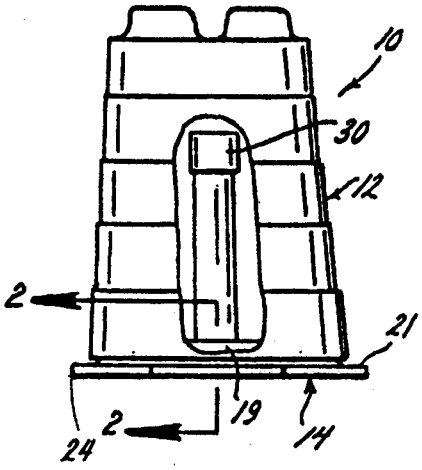
FIG. 1 is a plan view of a barrel and base according to the invention.
Figure 3:
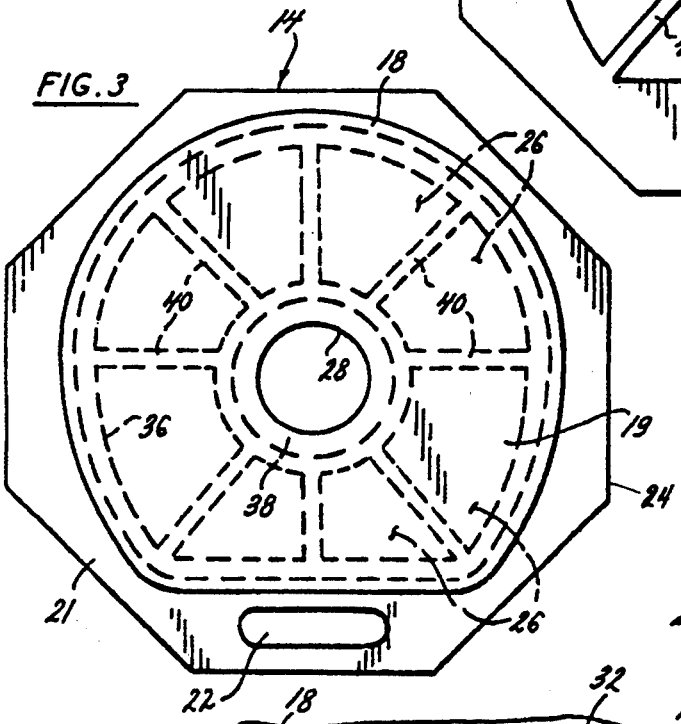
FIG. 3 is a top view of a base according to the invention.
Figure 5:
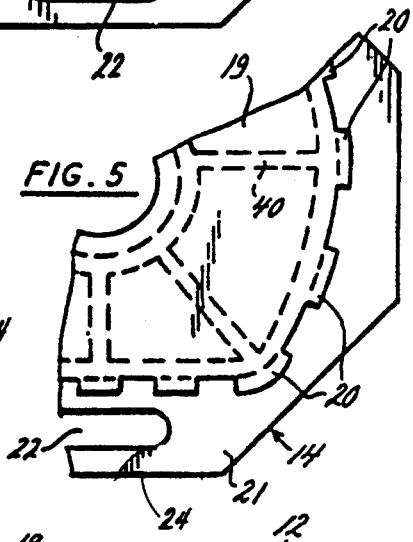
FIG. 5 is a fragmentary top view showing alternate latching means.

Referring to FIG. 1, a combination barrel and base 10 according to the invention are shown. The combination 10 includes a plastic channelizer barrel 12, which may be of conventional design including round, or D shaped as shown. Barrel 12 fits on a complimentary base 14 and is releasable attached by a lip 16, shown in FIG. 2, which engages with a projecting section 18 of the upper or pedestal portion 19 of base 14. As shown in FIG. 3 projecting section 18 may be continuous, or may be a series of discontinuous lugs 20 as shown in FIG. 5. It will be appreciated that continuous section 18 and lugs 20 are alternative engaging means for cooperating with lip 16 on barrel 12.

Figure 4:
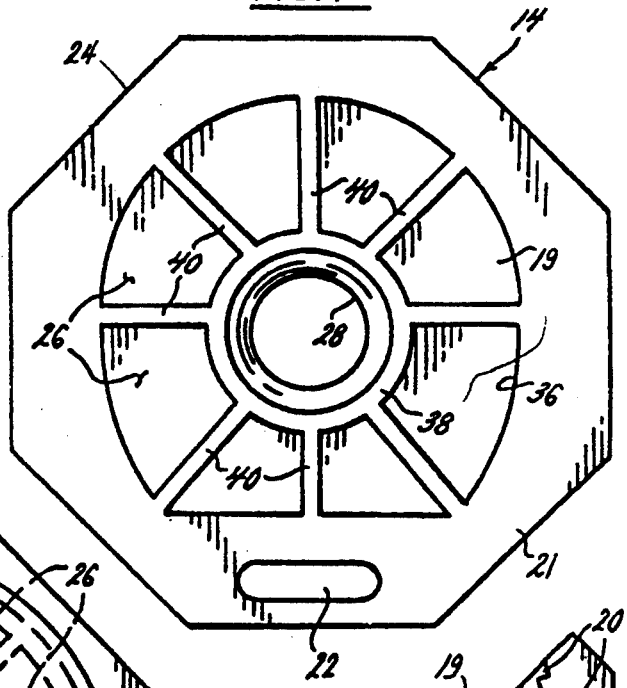
FIG. 4 is a bottom view of the base of FIG. 4.

As shown in FIGS. 3 and 4 for example, the lower or ground engaging portion 21 of base 14 is octagonal in shape, but it will be appreciated that it may be of any other conventional configuration including D shaped, round or elliptical among others. Also as shown in FIGS. 3 and 4, base 14 includes a hand-hole 22 for ease of carrying. It will be appreciated that hand-hole 22 may be included or not as desired and other means of manually carrying may be provided including placing the periphery 24 of base 14 sufficiently close to recess 26, described further herein, that the recess 26 can be readily grasped by the fingers of a hand.

Base 14 may also be provided with a central aperture 28 which may be used to install a conventional plastic delineator 30, for example as is shown in FIG. 1. It will be appreciated that aperture 28 may be omitted if desired. Alternatively, aperture 28 may be used to install a post for other traffic devices including a conventional sign stand, shown as 32 in FIG. 2.

Figure 2:
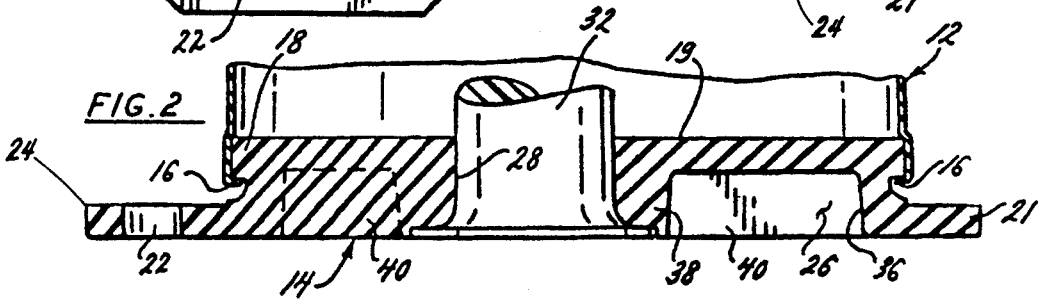
FIG. 2 is a partial cross-sectional view of the barrel and base of FIG. 1, taken along the plane of line 2—2 in FIG. 1.

As shown in FIGS. 2–4, the bottom surface of base 14 is relieved to form recesses or voids 26. Voids 26, by removing material from the base 14, permit the base 14 to be formed of highly compacted material, such as reprocessed rubber from automobile tires, and yet still possess a sufficient lightness in weight that it can be readily manually transported. Preferably base 14 will weigh about forty pounds. Voids 26 are bound by the inner periphery 36 and boss 38 extending around aperture 28, as shown. In addition, the voids 26 are further bound by a plurality of webs 40 extending radially outward from the center of base 14 as shown, and terminating at the inner periphery 36. The webs 40 also terminate at a location spaced outwardly from the center of base 14. As shown, the inner terminus of webs 40 is at boss 38 at the periphery of opening 28.

The composition of base 14, as noted herein, is preferably of recycled rubber such as reprocessed automobile tires which are molded and cured as is conventional in the art. Base 14 may also include sufficient new rubber or other elastomer polymers to bind the reprocessed rubber into a firm, resilient, unitary whole in a manner known in the art.

It will be readily understood by those skilled in the art that variations may be made to the embodiments disclosed herein without departing from the spirit of the invention disclosed. It is intended that applicants not be bound by the preferred embodiments, which are disclosed herein for purposes of illustration, but rather that they be limited only by the scope of the claims appended hereto and their equivalents.

We claim:

1. A low profile self-ballasting base for traffic control barrels comprising a dense, compact, resilient platform, the base being at least partially formed of recycled rubber from automobile tires, the base having an upper barrel engaging pedestal portion and a lower surface for contacting a roadway, the pedestal portion having peripheral means for releasably engaging a complementary shaped traffic barrel, the releasably engaging means being releasable on impact of a motor vehicle with the barrel, the lower surface of the base having a peripheral ground engaging portion, the ground engaging portion having an inner periphery thereof, the lower surface of the base having a plurality of voids therein, the voids terminating at the inner periphery of the ground engaging portion and extending inwardly therefrom, the lower surface of the base further having a plurality of radially extending webs thereon, the webs separating adjacent voids in the lower surface of the base, the webs terminating at the inner periphery of the ground engaging portion and extending radially inwardly therefrom, the webs and voids cooperating to provide weight reduction and strength to the base, the base being sufficiently heavy that additional ballast is not required and the base is substantially self-ballasting when combined with a traffic channelizer barrel.

2. The base of claim 1 wherein the base weighs between about 30 and 50 pounds.

3. The base of claim 1 wherein the base has a central aperture extending therethrough, the central aperture having means for receiving and supporting a traffic delineator therein.

4. The base of claim 3 wherein the voids are circumferentially distributed around the central aperture.

5. A low profile self-ballasting base for traffic control barrels comprising a dense, compact, resilient platform, the base being at least partially formed of recycled rubber from automobile tires, the base weighing between about 30 and 50 pounds, the base having an upper barrel engaging pedestal portion and a lower surface for contacting a roadway, the pedestal portion having peripheral means for releasably engaging a complementary shaped traffic barrel, the engaging means being releasable on impact of a motor vehicle with the barrel, the base having a central aperture extending therethrough, the base having a boss extending around the central aperture, the central aperture having means for receiving and supporting a traffic delineator therein, the lower surface of the base having a plurality of voids therein, the voids being circumferentially distributed around the central aperture, the lower surface further having a plurality of radially extending webs therein, the webs extending radially from the boss around the central aperture, the webs separating adjacent voids, the webs and voids cooperating to provide weight reduction and strength to the base, the base being sufficiently heavy that additional ballast is not required and the base is substantially self-ballasting when combined with a traffic channelizer barrel.

6. A low-profile self-ballasting base for traffic control barrels comprising a dense, compact, resilient platform, the base being at least partially formed of recycled rubber from automobile tires, the base having upper barrel engaging pedestal portion and a lower surface for contacting a roadway, the pedestal portion having peripheral means for releasably engaging a complementary shaped traffic barrel, the engaging means being releasable on impact of a motor vehicle with the barrel, the base having a central aperture extending therethrough, the base having a boss extending around the central aperture, the central aperture having means for receiving and supporting a traffic delineator therein, the lower surface of the base having a plurality of voids therein, the voids being circumferentially distributed around the central aperture, the lower surface further having a plurality of radially extending webs therein, the webs extending radially from the boss around the central aperture, the webs separating adjacent voids, the webs and voids cooperating to provide weight reduction and strength to the base, the base being sufficiently heavy that additional ballast is not required and the base is substantially self-ballasting when combined with a traffic channelizer barrel.

* * * * *